US010065780B1

(12) United States Patent
Jain

(10) Patent No.: US 10,065,780 B1
(45) Date of Patent: Sep. 4, 2018

(54) CONNECTOR ASSEMBLY

(71) Applicant: Genex Science and Technologies Pvt. Ltd., Andheri (East), Mumbai (IN)

(72) Inventor: Anil Jain, Mumbai (IN)

(73) Assignee: GENEX SCIENCE AND TECHNOLOGIES PVT. LTD., Mumbai (IN)

( * ) Notice: Subject to any disclaimer, the term of this patent is extended or adjusted under 35 U.S.C. 154(b) by 0 days.

(21) Appl. No.: 15/724,238

(22) Filed: Oct. 3, 2017

(30) Foreign Application Priority Data

Apr. 8, 2017 (IN) ..... 201721012699

(51) Int. Cl.
*B65D 71/50* (2006.01)
*B65D 71/00* (2006.01)

(52) U.S. Cl.
CPC ..... *B65D 71/50* (2013.01); *B65D 71/0096* (2013.01); *B65D 2571/00067* (2013.01)

(58) Field of Classification Search
CPC ..... B65D 2519/00293; B65D 2519/00273; B65D 2519/00552; B65D 2571/00111; B65D 19/44; B65D 19/39; Y10T 24/29
USPC ..... 108/57.13, 55.3, 55.5
See application file for complete search history.

(56) References Cited

U.S. PATENT DOCUMENTS 2,702,641 A * 2/1955 Arthur ..... B66C 1/625 211/85.18
2,782,916 A * 2/1957 Goenen ..... B65D 67/02 206/145
2,810,171 A * 10/1957 Brooks ..... B65D 67/02 206/159
2,838,818 A * 6/1958 Brennan ..... B65D 67/02 206/159
2,876,896 A * 3/1959 Ziehmer, Jr. ..... B65D 67/02 206/159
2,876,897 A * 3/1959 Taylor ..... B65D 67/02 206/159
2,898,654 A * 8/1959 Becker ..... B65D 67/02 206/159
3,065,857 A * 11/1962 Sanders ..... F17C 13/084 211/85.19
3,134,485 A * 5/1964 Bonkowski ..... B65D 71/50 206/159
3,143,210 A * 8/1964 Heydon ..... B65D 67/02 206/159
3,217,892 A * 11/1965 Goodell ..... B60P 7/12 211/85.18

(Continued)

*Primary Examiner* — Robert Sandy
*Assistant Examiner* — Rowland Do

(57) ABSTRACT

The present invention relates to a connector assembly. The connector assembly includes a connector (101) enabling connection amongst plurality of drums (501), wherein the connector 101 includes a plurality of clamping means (104) at multiple edges of the connector (101), connected to the connector (101) via a plurality of coupling elements (105, 201). A first portion (104*a*) of each clamping means (104) is coupled with one of the coupling elements (105, 201). The second portion (104*b*) of each clamping means (104) is adapted to fit within an outer reinforcing ring (504) of a drum to provide a fixed constraint to the plurality of drums (501) placed on a pallet (502). Further, the connector assembly includes a screw-rod fitting (103) having a screw rod (301) extending from the connector (101) and fastened at the pallet (502) positioned below the drums (501) to lock the connector (101) with the pallet (502).

11 Claims, 10 Drawing Sheets

(56) References Cited

U.S. PATENT DOCUMENTS

| | | | | |
|---|---|---|---|---|
| 4,403,556 | A * | 9/1983 | Van Gompel | B65D 19/44 108/55.3 |
| 5,259,524 | A | 11/1993 | Eckert | |
| 7,353,947 | B2 * | 4/2008 | Weissbrod | B65D 71/0088 206/386 |
| 9,669,976 | B2 * | 6/2017 | Kastanek | B65D 71/42 |
| 9,850,027 | B2 * | 12/2017 | Strauch | B65D 19/44 |

* cited by examiner

CONNECTOR ASSEMBLY

CROSS-REFERENCE TO RELATED APPLICATIONS AND PRIORITY

The present application does claim priority from the Indian patent application number 201721012699 filed on 8 Apr. 2017.

TECHNICAL FIELD

The present subject matter described herein, in general, relates to a field of industrial packaging products. In particular, the present subject matter is related to a connector assembly enabling connection amongst a plurality of drums.

BACKGROUND

Industrial packaging products include drums, containers, boxes, paper packaging etc. Every year accidents occur while these products are being stacked or de-stacked and put into or taken out of storage. Many of these accidents are serious some are fatal. While these hazards are always present, proper work practices such as minimizing handling and using equipment and procedures that isolate workers from hazardous substances can minimize the risks to site personnel. There is an enormous variety of storage systems and stacking methods in use today.

The industrial packaging products can be used for transporting chemical substances which are toxic, hazardous, viscous, expensive and explosive. Hence, it is very essential to connect all the drums in proper order while stacking. When the drums are stacked, bottom surface of a drum on top usually slides on a lid of the drum at the bottom thereby affecting the stability of the stack itself. Therefore, the drums/containers being stacked are required to be positioned and held such that there is no possibility of accidents due to movement or shifting of the drum/container stacking assembly.

In one of the existing methods adopted for preventing unwanted movement or shifting of drums or containers stored in groups of two or more, a core member is positioned amongst or between the drums or containers and at least one pressure exerting member or strap is utilized to urge the drums or containers inwardly into direct abutment with the core member. The core member may be specifically configured such that the individual drums or containers will nest or seat firmly against the core member. The pressure-exerting member may comprise any suitable type of pressure-exerting apparatus or article including strap(s), band(s), plastic shrink wrapping, cable, chains, etc. However, utilizing the pressure-exerting member for holding the containers/drums is risky since the pressure-exerting member may fail to continuously exert the pressure on the containers and hence is bound to release the drums/containers thereby separating the grouped containers/drums ultimately resulting in accidental/hazardous conditions during the transport of the containers/drums.

Further, there are other various methods/apparatuses/devices available in the market that facilitates in connecting multiple drums while packaging or transporting. However, these various methods/apparatuses suffer from several drawbacks/limitations including, but not limited to, bulkiness, corrosive, breakable, costly, susceptible to cracks while transportation, less tensile strength, less flexibility, and less stress handling capacity etc. Therefore, there is long standing need for an improved assembly enabling connection amongst a plurality of drums while stacking and transporting having good flexibility, lightweight, good tensile and stress handling capacity thereby alleviating the drawbacks/limitations of the existing methodologies and devices/apparatuses.

SUMMARY

This summary is provided to introduce concepts related to a connector assembly enabling connection amongst plurality of drums. This summary is not intended to identify essential features of the claimed subject matter nor it is intended for use in determining or limiting the scope of the claimed subject matter.

In one implementation, a connector assembly is described herein. The connector may comprise a plurality of U-shaped clamping means at multiple edges of the connector connected to the connector via a plurality of coupling elements. In one aspect, a first portion of each of the clamping means is coupled with one of the coupling elements. Further, the second portion perpendicular to the first portion is adapted to clamp an outer reinforcing ring of the drum from both inside and outside of the said outer reinforcing ring such that the connector is surrounded by the plurality of drums and placed below the bottom surface of the outer-reinforcing ring of the drums thereby providing a fixed constraint to the plurality of drums placed on a pallet. The connector may further comprise a screw-rod fitting comprising a screw rod extending from the center of the connector and fastened at the pallet positioned below the drums. The screw-rod fitting may be adapted to lock the connector with the pallet. The screw rod may act as a connecting rod between the connector and the pallet.

Further, the connector may comprise a plurality of surface corrugations providing strength to the surface of the connector to overcome the tensile and bending loads while locking and holding of the plurality of drums. The connector may further comprise a plurality of cut-outs on the surface of the connector. The plurality of cut-outs may enable reducing the stress concentration at the cut-outs and thereby increasing the load bearing capacity of the connector. Further, the plurality of cut-outs may enable reducing weight of the connector. Further, the plurality of cut-outs may allow seepage of water or any liquid content accumulated on the connector. Furthermore, the plurality of cut-outs may enable a provision to check whether the screw-rod of the screw-rod fitting is fixed at an appropriate location within the pallet.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to refer like features and components.

DETAILED DESCRIPTION

Reference throughout the specification to "various embodiments," "some embodiments," "one embodiment," or "an embodiment" means that a particular feature, structure, or characteristic described in connection with the embodiment is included in at least one embodiment. Thus, appearances of the phrases "in various embodiments," "in some embodiments," "in one embodiment," or "in an embodiment" in places throughout the specification are not necessarily all referring to the same embodiment. Furthermore, the particular features, structures or characteristics may be combined in any suitable manner in one or more embodiments.

Figure 1:
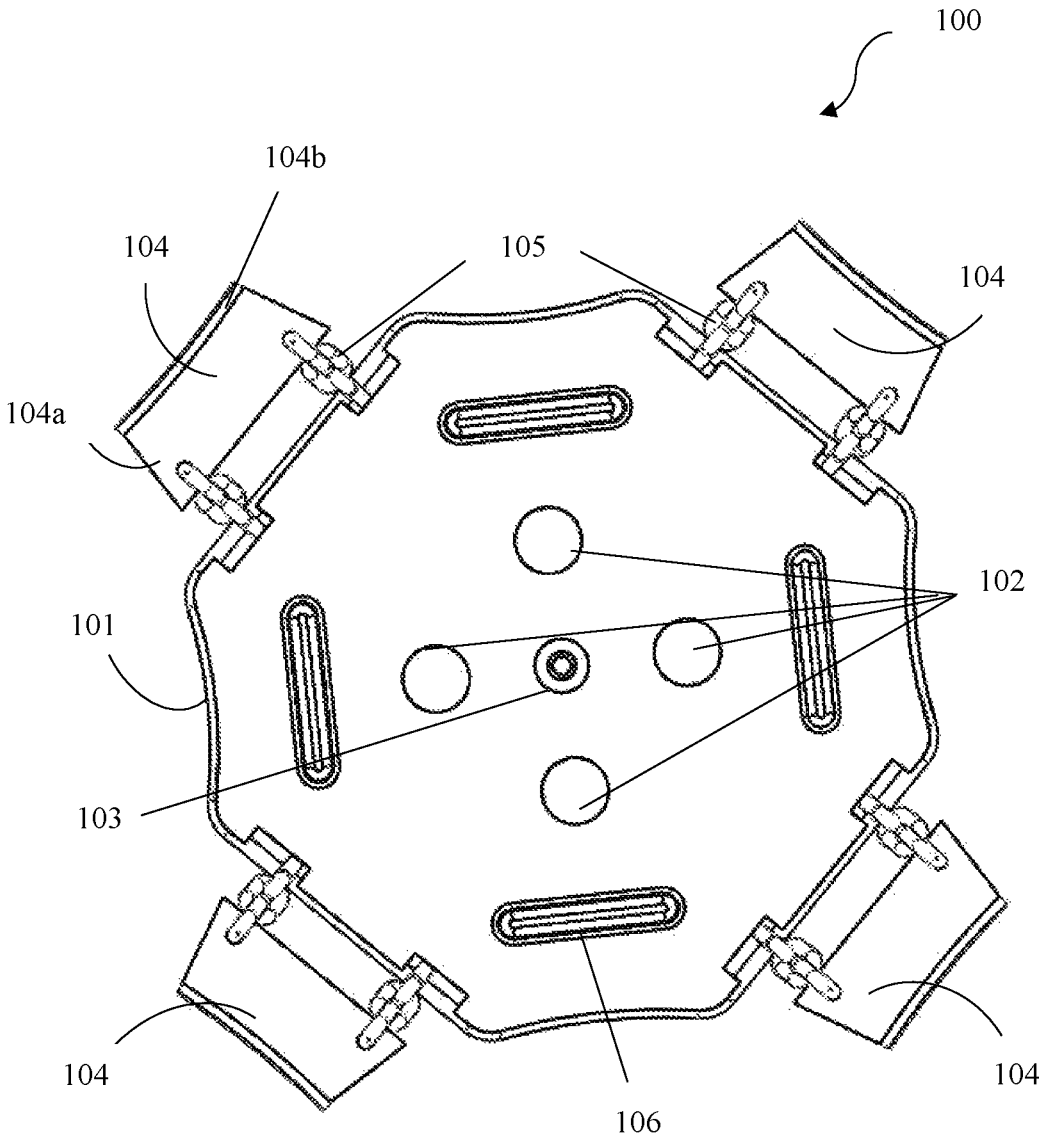
FIG. 1 illustrates a top view 100 of a connector 101 enabling connection amongst a plurality of drums via chains 105, in accordance with an embodiment of the present disclosure.
Figure 2:
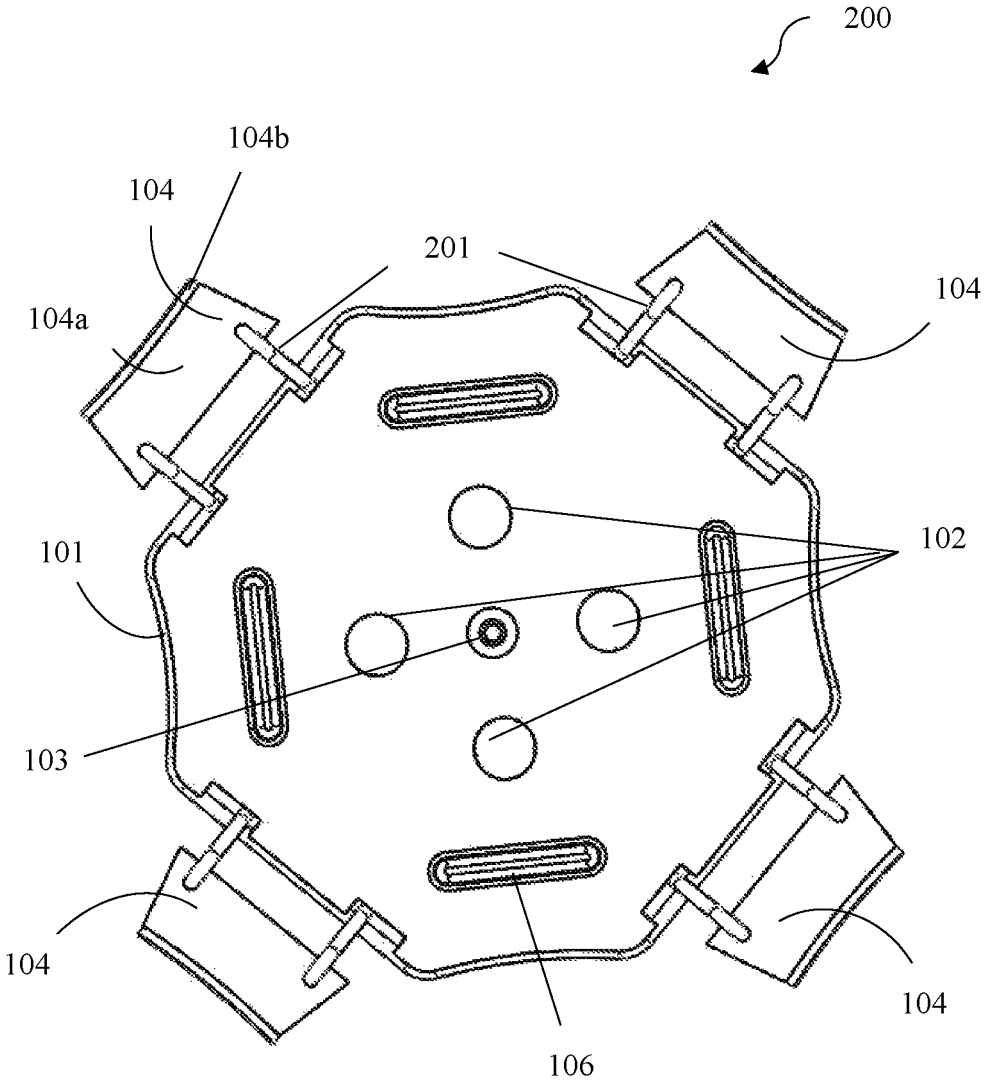
FIG. 2 illustrates a top view 200 of a connector 101 enabling connection amongst a plurality of drums via links 201, in accordance with an embodiment of the present disclosure.

Referring to FIGS. 1 and 2, top views 100 and 200 of a connector 101 enabling connection amongst a plurality of drums via a plurality of coupling elements (105, 201) are illustrated, in accordance with an embodiment of the present disclosure. In one embodiment, the connector 101 may comprise a plurality of clamping means 104 connected at multiple edges of the connector 101, a screw-rod fitting 103, a plurality of surface corrugations 106 and a plurality of cut-outs 102 on the surface of the connector 101. The said clamping means 104 may enable clamping of the connector 101 with a plurality of drums placed relatively with each other and the connector 101. In one embodiment, the clamping means 104 may further comprise a first portion 104*a* coupled with one of the coupling elements (105, 201) and a second portion 104*b* adapted to clamp an outer reinforcing ring 504 of the drum from both inside and outside of the said outer reinforcing ring 504 in order to clamp the plurality of drums. Therefore, the clamping means 104 may be configured to act as a reinforcing ring holder. Hereinafter, the clamping means 104 may be referred to as a reinforcing ring holder 104 interchangeably. The clamping means 104 may be connected with the connector 101 via the plurality of coupling means (105, 201). In one embodiment, the coupling means (105, 201) may include either a chain 105 or a link 201 made of a metal or alike material. The selection of either the chain or the link as the coupling means (105, 201) is based on multiple factors at least including overall load exerted by the drums. For example, as shown in FIG. 1, the clamping means 104 may connect with the drums via the coupling means 105 such as a chain. Further, as shown in FIG. 2, the clamping means 104 may connect with the drums via the coupling means 201 such as link. It must be noted that the coupling elements in form of chains 105 or links 201 may provide flexible clamping of the drums even if the drums are slightly off-positioned during transit and are of different shapes and sizes. Further, the connector 101 may comprise a plurality of surface corrugations 106 for providing strength to the surface of the connector 101. Furthermore, the connector 101 may comprise a plurality of cut-outs 102 on the surface of the connector 101. The functionalities of the plurality of cut-outs may include, but not limited to, reducing the stress concentration at the cut-outs 102 and thereby increasing the load bearing capacity of the connector 101, reducing weight of the connector 101, allowing seepage of water or any liquid content accumulated on the connector 101, and enabling a provision to check if a screw-rod of the screw-rod fitting 103 is fixed at an appropriate location within a pallet.

Figure 3A:
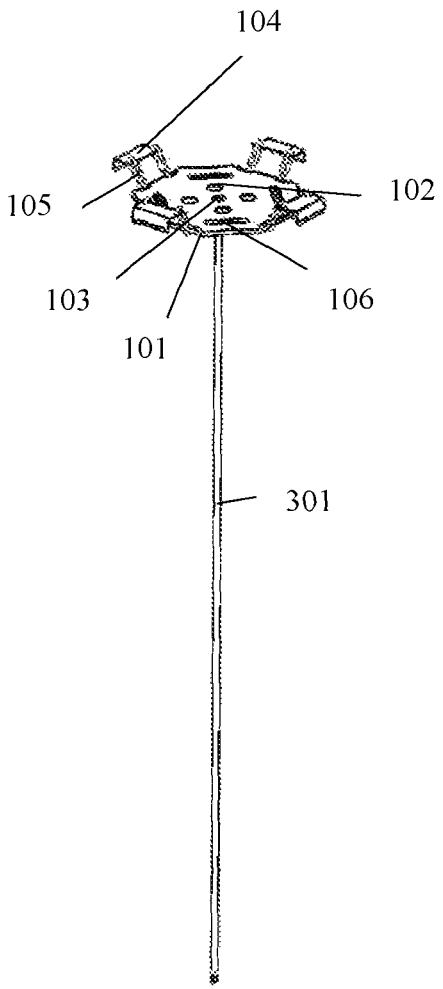
FIGS. 3*a* and 3*b* illustrate perspective views of the connector 101 along with a screw rod fitting 103, in accordance with an embodiment of the present disclosure.
Figure 3B:
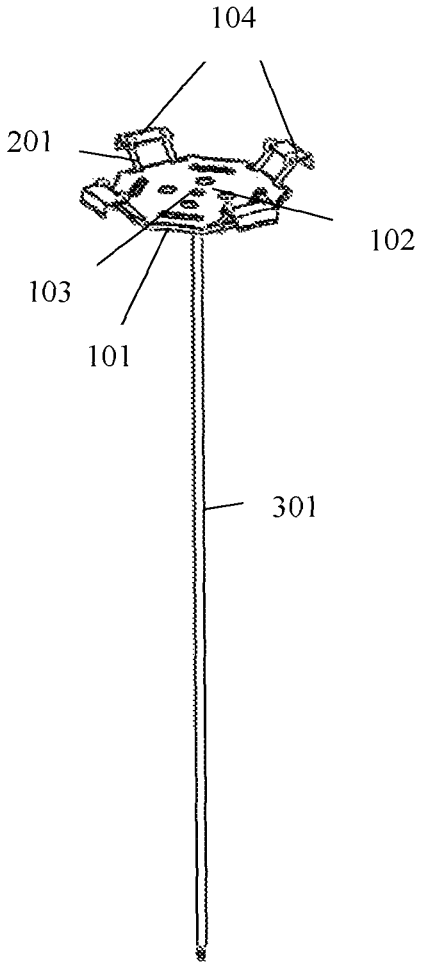
Figure 4A:
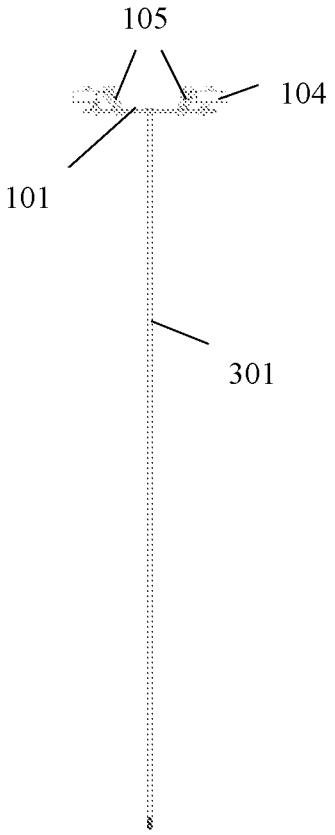
FIGS. 4*a* and 4*b* illustrate side views of the connector assembly, in accordance with an embodiment of the present disclosure.
Figure 4B:
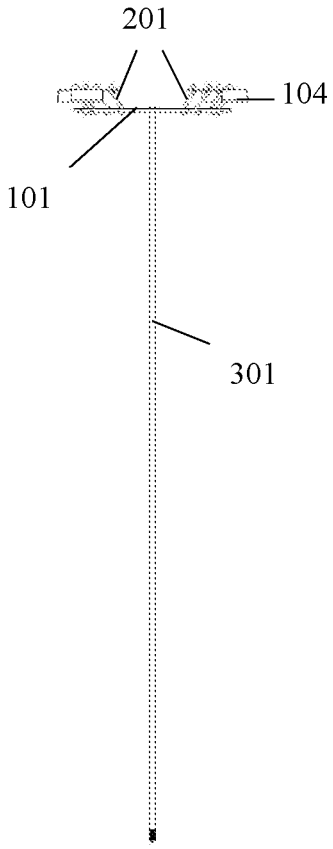

Now referring to FIGS. 3*a* and 3*b*, perspective views of the connector 101 along with a screw rod fitting 103 enabling connection amongst a plurality of drums are illustrated, in accordance with an embodiment of the present disclosure. Further, FIGS. 4*a* and 4*b* illustrate side views of the connector assembly enabling connection amongst a plurality of drums, in accordance with an embodiment of the present disclosure. As shown, the connector 101 of the connector assembly may comprise the screw-rod fitting 103, wherein the screw-rod fitting 103 may further comprise a screw rod 301 extending from the center of the connector 101 and fastened at the center of a pallet (not shown in FIGS. 3*a* and 3*b*), wherein the pallet may be positioned below the drums. The said screw-rod fitting 103 may be adapted to lock the connector 101 with the pallet. The screw rod 301 may act as a connecting rod between the connector 101 and the pallet. The screw rod 301 may be configured to support the whole assembly enabling connection amongst a plurality of drums. In one embodiment, the screw-rod fitting 103 may further comprise a fixed screw fitting on an upper edge of the screw-rod 301 to provide stable fixature of the connector assembly. Further, the screw-rod 301 may comprise threading at the bottom edge to facilitate fastening of the screw-rod 301 with the pallet via nuts and bolts. The screw-rod fitting 103 may provide additional stability to the plurality of drums.

Figure 5:
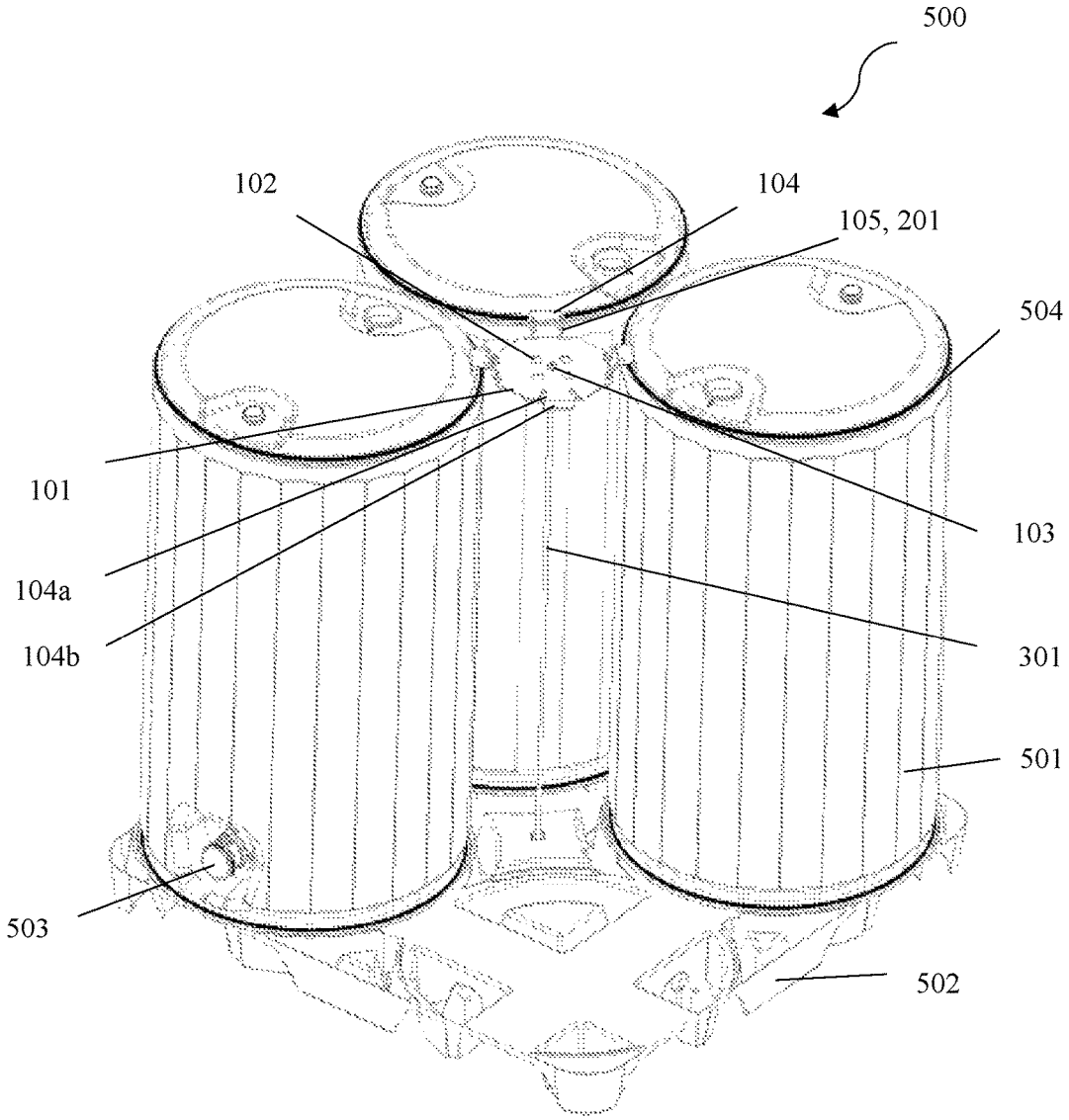
FIG. 5 illustrates a partial perspective view 500 of an assembly of a plurality of drums 501 placed on a pallet 502 and connected via the connector 101, in accordance with an embodiment of the present disclosure.
Figure 7:
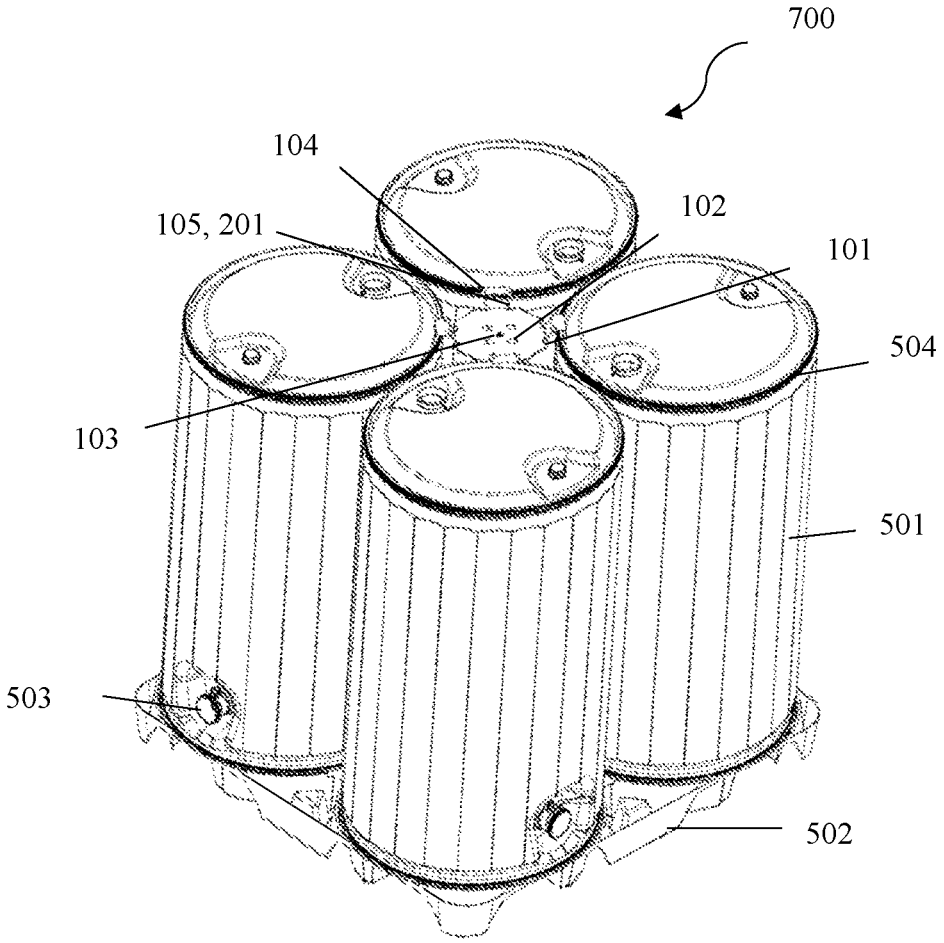
FIG. 7 illustrates a perspective view 700 of the assembly of the plurality of drums 501 placed on the pallet 502 and connected via the connector 101, in accordance with an embodiment of the present disclosure.

Referring now to a FIG. 5 and FIG. 7, a perspective view 500 and a partial perspective view 700 of an assembly of a plurality of drums 501 placed on a pallet 502 and connected via the connector 101 are illustrated. In one embodiment, the assembly may comprise the connector 101 connected to the plurality of drums 501 placed on the pallet 502 and a metal insert (not shown in figure) for receiving the screw-fitting rod 301 of the connector 101.

It must be noted that, the drums, containers etc. while stacking, packaging or transporting may be required to be placed in a fixed constraint on a pallet. The said fixature may be obtained by the connector 101, wherein the connector 101 may relatively provide connection amongst the plurality of drums 501 as shown in FIG. 5 and FIG. 7. In one embodiment, said connector 101 may be polygonal in shape and may be made of material including, but not limited to, a metal, a polymer or any alike material. In one embodiment, the connector 101 may be powder coated or electroplated for prevention against rusting and corrosion due to atmospheric effect. The connector 101 may comprise a plurality of U-shaped clamping means 104 connected at multiple edges of the connector 101. The reinforcing ring holder 104 may be connected to the connector 101 via the plurality of coupling means (105, 201) for enabling clamping of the connector 101 with the plurality of drums 501, wherein the plurality of drums 501 may be placed relatively with each other and the connector 101. A first portion 104*a* of each of the reinforcing ring holder 104 may be coupled with one of the coupling elements 105. A second portion 104*b* perpendicular to the first portion 104*a* may be adapted to clamp an outer reinforcing ring 504 of the drum from both inside and outside of the said outer reinforcing ring 504 such that the connector 101 may be surrounded by the plurality of drums 501. The connector 101 may be placed below the bottom surface of the outer reinforcing ring 504 of the drums 501, preferably 10 to 100 mm below, to prevent damage of the drums 501. The connector 101 may be configured to provide a fixed constraint to the plurality of drums 501 placed on the pallet 502.

Figure 6:
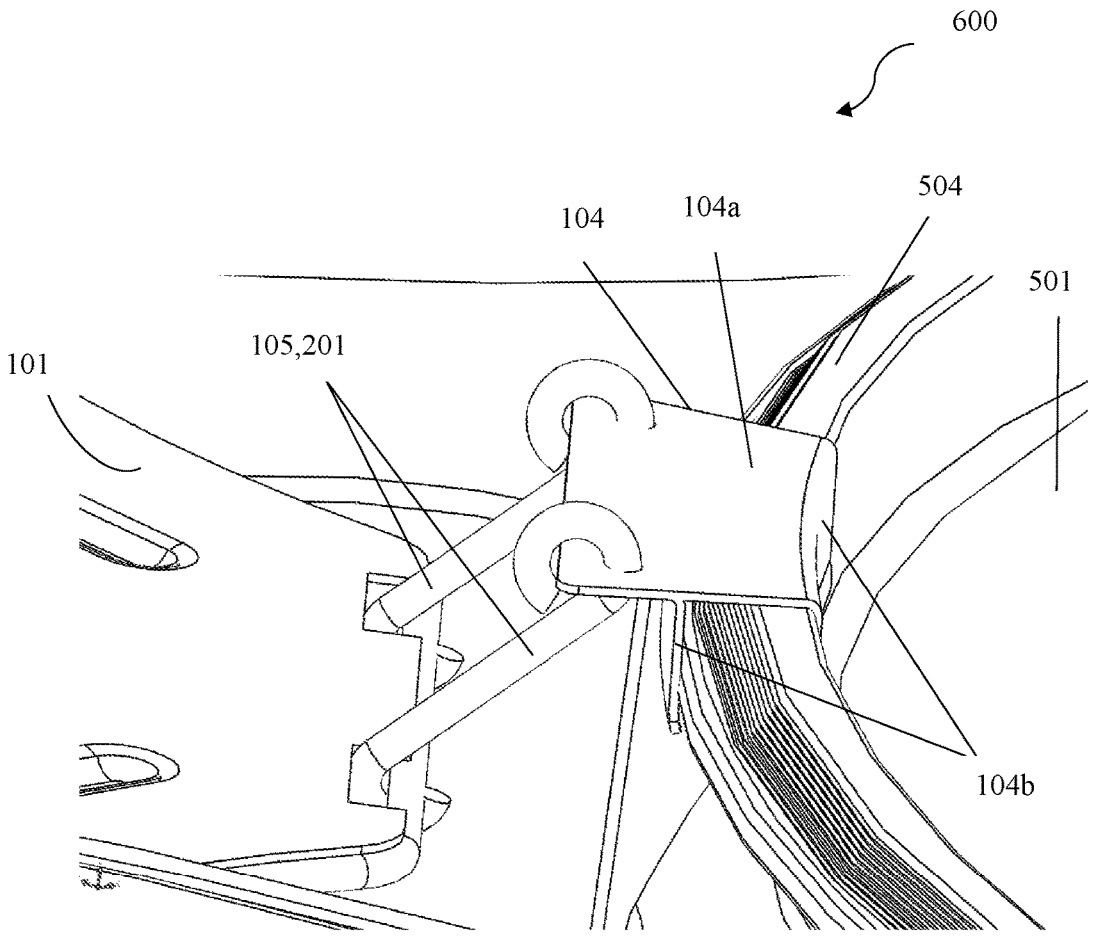
FIG. 6 illustrates a magnified view 600 of the connector 101 locking each drum of the plurality of drums 501, in accordance with an embodiment of the present disclosure.

Referring now to FIG. 6 a magnified view 600 of the connector 101 clamping a drum from the plurality of drums 501, is illustrated. In one embodiment, the reinforcing ring holder 104 comprised in the connector 101 may be U-shaped containing a first portion 104*a* and a second portion 104*b*. The first portion 104*a* of the said U-shaped ring holder 104 may be a continuous flat structure, wherein the said continuous flat structure is perpendicular to the second portion 104*b*. The flat structure may have continuous extension, and wherein the coupling means 105, 201 may be locked in the said continuous extension. The second portion 104*b* may comprise two metal ribs wherein, said metal ribs may be configured to clamp the outer reinforcing ring 504 of the drum from both inside and outside of the said outer reinforcing ring 504 in order to arrest the mobility of drum after clamping.

In one embodiment, the coupling elements (105, 201) may be made of metals or plastics. The clamping may provide a fixed constraint to the plurality of drums 501 placed on the pallet 502. In one embodiment, the connector assembly may further comprise a screw-rod fitting 103, wherein the screw-rod fitting 103 may further comprise a screw rod 301 extending from the center of the connector 101 and fastened at the center of the pallet 502. In one embodiment, the fastening of the screw-rod 301 on the pallet 502 may be enabled by a metal insert 900 illustrated in FIG. 9. In one embodiment, the screw-rod 301 may be made of metal or like materials, but not limited to such materials.

Figure 8:
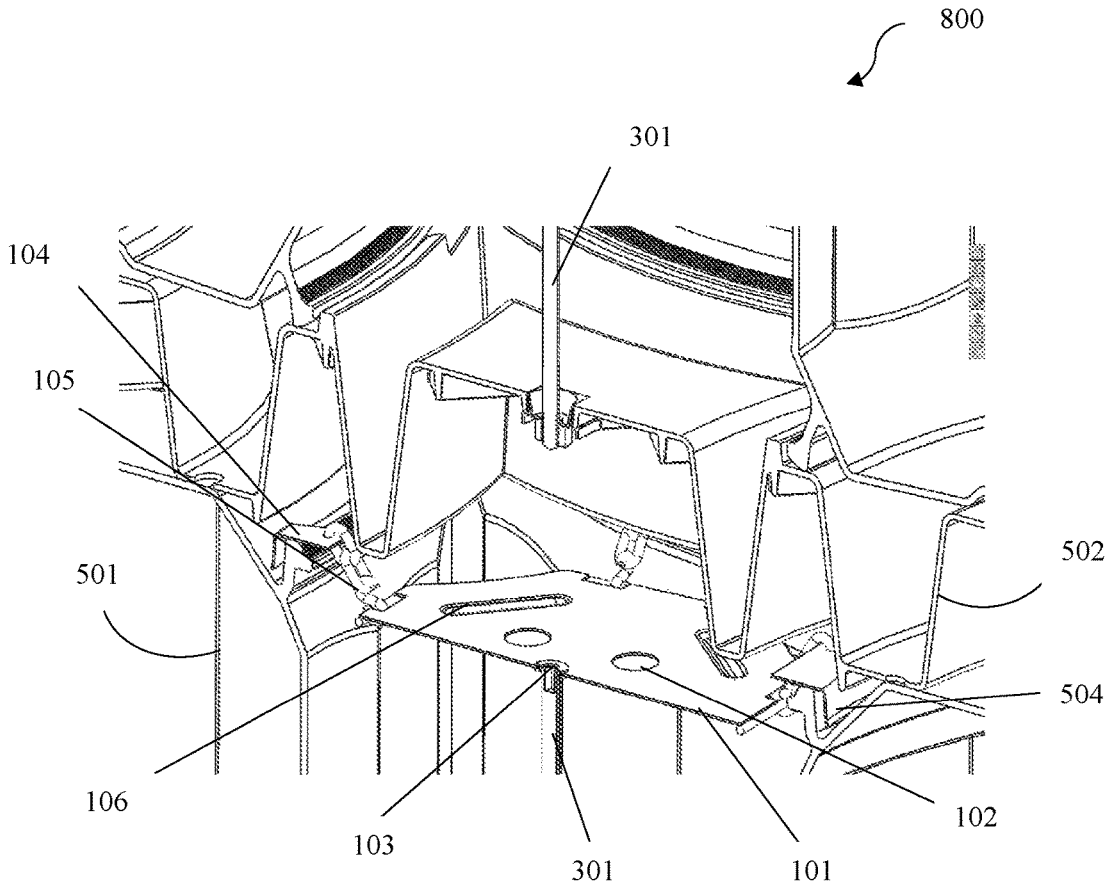
FIG. 8 illustrates a cross sectional view 800 of a drum stacking assembly along with the connector 101, in accordance with an embodiment of the present disclosure.

FIG. 8 illustrates a cross sectional view 800 of a drum stacking assembly along with the connector 101, in accordance with an embodiment of the present subject disclosure. In one embodiment, the drum stacking assembly may comprise a first stack of a first set of drums 501 placed on a pallet (not shown in figure). The first set of drums 501 may be relatively placed with each other in the pallet with the help of the connector assembly. The connector 101 of the connector assembly may be fixed in the said pallet such that the first set of drums 501 may be surrounded around the connector 101. The connector 101 may be placed at a predetermined distance from the top of the first set of drums 501 and may be clamped with the first set of drums 501 via the clamping means 104. In one embodiment, the fixature of the connector 101 to the clamping means 104 may be performed via chains 105. In one embodiment, the screw rod fitting 103 of the connector assembly may enable one end of the screw rod 301 to be fixed on the upper surface of the connector 101 and the other end on the pallet. In one embodiment, a second stack of a second set of drums (not shown) may be placed above the first stack of the first set of drums 501. In one embodiment, the second stack may comprise a pallet 502 fitted on the first stack of the first set of drums 501. One or more legs of the pallet 502 may be engaged in the outer reinforcing ring 504 of the said drums 501 of the first stack. In one embodiment, the pallet 502 may also be grooved in accordance with dimensions of the connector assembly such that the connector 101 may lie under the central groove of the pallet 502. In one embodiment, the lower end screw rod 301 of the second stack may be fixed on the pallet 502 at the bottom surface with the help of a metal insert (not shown).

Figure 9:
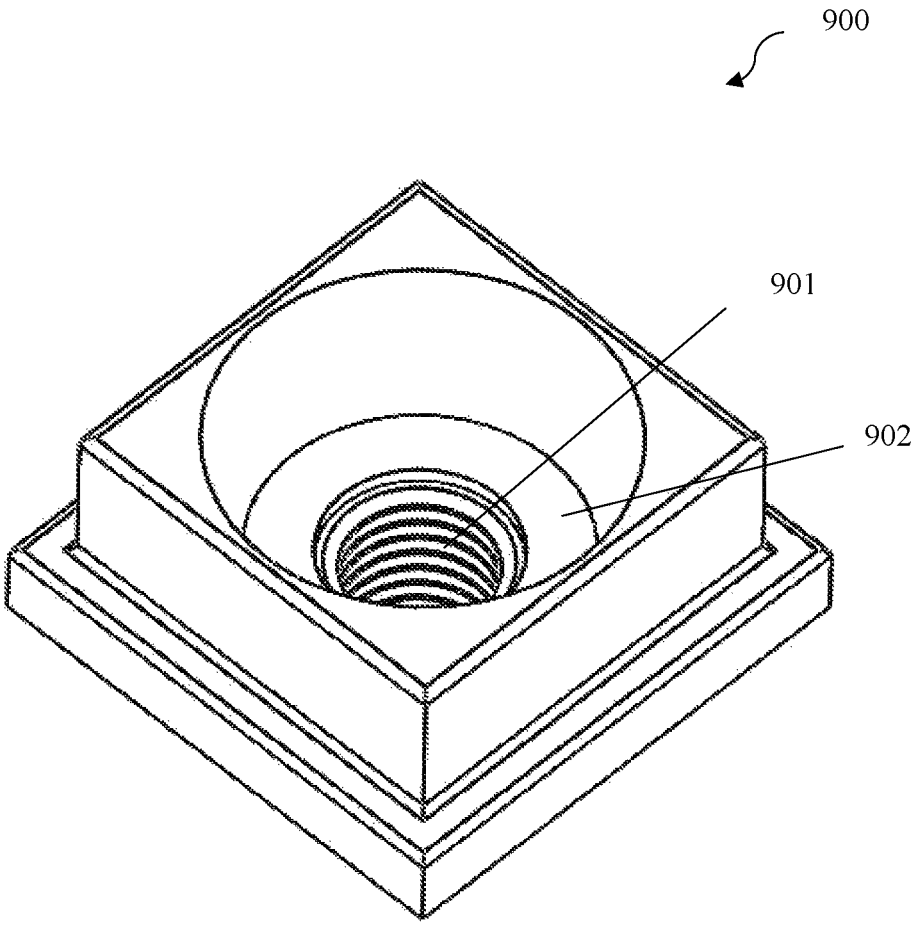
FIG. 9 illustrates a metal insert 900 for insertion and fixature of the screw-rod 301, in accordance with an embodiment of the present disclosure.

Referring to FIG. 9, the metal insert 900 for insertion and fixature of the screw-rod 301 is illustrated, in accordance with an embodiment of the present disclosure. In one embodiment, the metal insert 900 may enable insertion and predefined fixature of the screw-rod 301 within the pallet 502. The metal insert 900 may provide a proper fastening to the screw-rod 301 at the center of the pallet 502. The metal insert 900 may be configured for guiding the screw-rod 301 into the pallet 502 via threading's 901 and beveled edges 902.

Figure 10A:
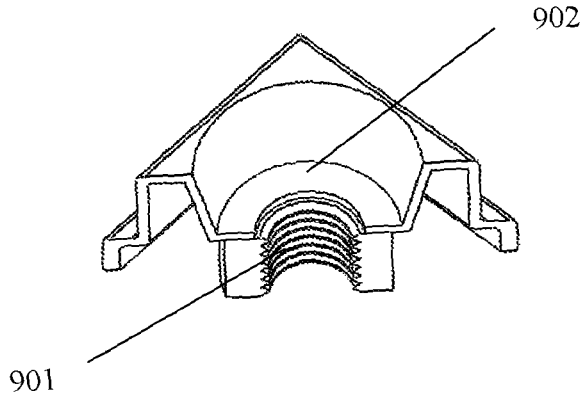
FIG. 10*a* illustrates a cross section view of metal insert 900, in accordance with an embodiment of the present disclosure.
Figure 10B:
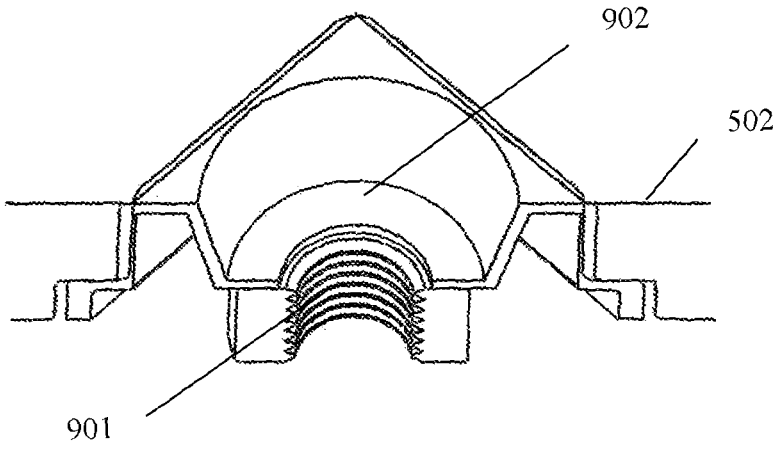
FIG. 10*b* illustrates a cross section view of metal insert 900 affixed with the pallet 502, in accordance with an embodiment of the present disclosure.

Referring to FIGS. 10*a* and 10*b*, a cross section view of the metal insert 900 and a cross section view of the metal insert 900 affixed with the pallet 502, are illustrated, respectively, in accordance with an embodiment of the present disclosure. In one embodiment, the metal insert 900 may be affixed at the bottom surface the pallet 502 at the center of the said pallet 502. The metal insert 900 may comprise a central portion for engaging the screw-rod 301 via threadings 901 and one or more beveled edges 902. The central portion may be visible from the top view of the pallet 502. In one embodiment, the metal insert 900 comprises one or more beveled edges 902 for providing wear resistance, aesthetics and to facilitate mating. In one embodiment, the metal insert 900 may be affixed to the pallet 502 from bottom of the said pallet 502. The affixing of the metal insert 900 with the pallet 502 may be performed during molding of the pallet 502 or later as per requirements.

In accordance with an embodiment of the present disclosure, the pallet 502 and the plurality of drums 501 may together be stacked on another pallet, holding a plurality of drums 501 connected via another connector assembly. The said connector assembly may be economic, flexible, lightweight, nearly unbreakable. The connector assembly also has good tensile and stress handling capacity.

Although implementations of a connector assembly have been described in language specific to structural features and/or methods, it is to be understood that the appended claims are not necessarily limited to the specific features or methods described. Rather, the specific features are disclosed as examples of a connector assembly.

The invention claimed is:

1. A connector assembly, comprising:

a connector (101) enabling connection amongst a plurality of drums (501), wherein the connector (101) comprises a plurality of U-shaped clamping means (104) at multiple edges of the connector (101), wherein each of the clamping means (104) is connected to the connector (101) via a plurality of coupling elements (105, 201), wherein the plurality of coupling elements (105, 201) enables separation between the connector (101) and the clamping means (104) in order to provide flexible clamping of the plurality of drums (501) even if the plurality of drums (501) are slightly off-positioned during transit and are of different shapes and sizes, wherein a first portion (104*a*) of each of the clamping means (104) is coupled with one of the coupling elements (105, 201), and wherein a second portion (104*b*) perpendicular to the first portion (104*a*) is adapted to clamp the outer reinforcing ring (504) of a drum of the plurality of drums (501) from both inside and outside of the outer reinforcing ring (504) of the drum via two metal ribs to provide a fixed constraint to the plurality of drums (501) placed on a pallet (502), wherein the first portion (104*a*) and the second portion (104*b*) are horizontally wide in dimensions in order to clamp a larger area of the drum;

a screw-rod fitting (103) comprising a screw rod (301) extending from the connector (101) and fastened at the pallet (502) positioned below the drums (501), wherein the screw-rod fitting (103) is adapted to lock the connector (101) with the pallet (502); and a metal insert (900) comprising a central portion for engaging the screw-rod (301) into the pallet (502) via threadings (901) and beveled edges (902), wherein the central portion is visible from the top view of the pallet (502), and wherein the metal insert (900) is affixed to the pallet (502) from the bottom surface, at the center of the pallet (502).

2. A connector assembly as claimed in claim 1, wherein the connector (101) is made of a material selected from a group comprising a metal, a plastic, and a polymer, and wherein the material is either powder coated or electroplated.

3. A connector assembly as claimed in claim 2, wherein the connector (101) is polygonal in shape.

4. A connector assembly as claimed in claim 3, wherein the connector (101) further comprises a plurality of surface corrugations (106) on the surface of the connector (101).

5. A connector assembly as claimed in claim 4, wherein the connector (101) further comprises a plurality of cut-outs (102) on the surface of the connector (101).

6. A connector assembly as claimed in claim 5, wherein the connector (101) is surrounded by the plurality of drums (501) and placed below the bottom surface of the outer reinforcing ring (504) of the drums (501).

7. A connector assembly as claimed in claim 1, wherein each of the plurality of coupling elements is either a chain (105) or a link (201).

8. A connector assembly as claimed in claim 7, wherein the chains (105) or links (201) are made of a metallic material or a plastic material.

9. A connector assembly as claimed in claim 1, wherein the screw-rod fitting (103) is extended from the center of the connector (101) and fastened at the center of the pallet (502), and wherein the screw-rod fitting (103) provides required support and stability to the plurality of drums (501) connected.

10. A connector assembly as claimed in claim 1, wherein the pallet (502) and the plurality of drums (501) together are stacked on another pallet holding a plurality of drums (501) connected via another connector assembly.

11. A connector assembly as claimed in claim 1, wherein the beveled edges (902) are capable of providing wear resistance, aesthetics and to facilitate mating.

* * * * *